US005505996A

United States Patent [19]

Nagayama

[11] Patent Number: 5,505,996

[45] Date of Patent: Apr. 9, 1996

[54] METHOD FOR FORMING A TWO-DIMENSIONAL THIN FILM OF PARTICLES

[75] Inventor: Kuniaki Nagayama, Tokyo, Japan

[73] Assignee: Research Development Corporation of Japan, Tokyo, Japan

[21] Appl. No.: 420,717

[22] Filed: Apr. 11, 1995

Related U.S. Application Data

[63] Continuation of Ser. No. 142,148, Oct. 28, 1993, abandoned.

[30] Foreign Application Priority Data

Oct. 28, 1992 [JP] Japan ..... 4-289983

[51] Int. Cl.[6] ..... B05D 5/12

[52] U.S. Cl. ..... 427/123; 427/146; 427/404; 427/445

[58] Field of Search ..... 427/123, 146, 427/404, 445

[56] References Cited

U.S. PATENT DOCUMENTS 4,512,862 4/1985 Rigby ..... 427/126.4
4,675,071 6/1987 Matsumota et al. ..... 156/621

OTHER PUBLICATIONS

H. W. Deckman et al., "Micromolecular self-organized assemblies," J. Voc. Sci. Technol. B 6(1) Jan./Feb. 1988 pp. 333–336.

H. W. Deckman et al., "Natural Lithography," Appl. Phys. Lett. 41(4) 15 Aug. 1982 pp. 377–379.

H. Yoshimura et al. "Hexagonal Structure of Two-Dimensional Crystals of the $\alpha_3\beta_3$ Complex of Thermophilic ATP Synthase,"J. Biochem. 106(6) 1989 pp. 958–960

Denkov et al., American Chemical Society, vol. 8, No. 12, "Mechanism of Formation of Two-Dimensional Crystals from Latex Particles on Substrates", pp. 3183–3190, 1992.

Nature, vol. 361, Scientific Correspondence, "Two-dimensional crystallization", Jan. 7, 1993.

Dushkin et al., Chemical Physics Letters, vol. 204, Nos. 5,6, "Nucleation and growth of two-dimensional colloidal crystals", Mar. 26, 1993, pp. 455–460.

Paunov, et al., "Journal of Colloid and Interface Science", Lateral Capillary Forces between Floating Submillimeter Particles, pp. 100–112, 1993.

*Primary Examiner*—Benjamin Utech
*Attorney, Agent, or Firm*—Wenderoth, Lind & Ponack

[57] ABSTRACT

A particle-containing or particle-forming liquid is spread over the surface of a high density liquid; the particles are aggregated two-dimensionally by reducing the thickness of the particle-containing or particle-forming liquid which has been spread; and the aggregated and formed two-dimensional particle thin film is brought into contact with the surface of a solid substrate to transfer and fix said thin film thereupon. By this method, it is possible to form a two-dimensional aggregate quickly, and form two-dimensional particle thin film of a high quality.

9 Claims, 6 Drawing Sheets

METHOD FOR FORMING A TWO-DIMENSIONAL THIN FILM OF PARTICLES

This application is a continuation of now abandoned application, Ser. No. 08/142,148, filed Oct. 28, 1993.

FIELD OF THE INVENTION

The present invention relates to a method for forming a two-dimensional thin film of particles. More particularly, the present invention relates to a new method for forming a two-dimensional thin film of particles which is useful for the production of new functional materials used in various fields including electronics and bio-materials.

PRIOR ART

Fine particles and thin films thereof have long been considered a promising new material for realizing a new and high level function in the field of electronics and bio-materials, and methods to form thin films from fine particles have been actively studied. Various methods to form particles in the form of thin films have been known. These methods use two types of substrates. One uses the surface of a solid as the substrate and the other uses the surface of a liquid.

The method of using the solid surface for spreading particles thereupon includes, for example, a drying method wherein a particle-containing solution is placed on a solid substrate, such as glass, which is placed horizontally to form thin films thereon via a drying process; a spin coat method wherein a particle-containing solution is coated on a solid substrate; a combination of a spin coat and a drying method, and an adsorption method wherein glass or other substrates are slowly immersed into a particle-containing liquid perpendicularly and the particles adsorbed are fixed on the surface of the substrate.

The method of using a liquid surface as the substrate on which particles are spread includes, for example, the most extensively applied and commonly used LB (Langmuir Blodgett) film method wherein the particles are strayed on an interface between water and air and are transferred to a secondary solid substrate via physical concentration such as compression.

However, it is not easy to form particles in a two-dimensional thin film of a high quality at a high efficiency and to control its assembly structure or organization. Actually attempts to apply these methods to fine practices has major drawbacks.

The most critical problems of the conventional methods include, for example, 1) nonuniform particle placement, 2) very low thin film forming speed, 3) difficulty of formation and control of a single particle layer, and 4) difficulty of applying of the method to fine particles in the order of nanometers.

The reasons why these problems are unavoidable include 1) nonuniform particle placement because of, mainly, poor flatness of the surface of solid substrates which is intrinsic to such substrates, and 2) low crystal-like or crystalline thin film formation speed due to a low level of cleanliness of the solid and liquid substrate surfaces. Poor flatness and low level of cleanliness of the substrate surface decreases the power of the particles to aggregate, and thus only film of a small density and affected by a number of losses is produced.

Further, the problems of 3) the difficulty of formation and control of a single particle layer and 4) the difficulty of applying the method to fine particles having sizes in the order of nanometers have not been solved because there has been no means to evaluate the force applied to individual particles.

The present invention has been made in consideration of the above and solves the problems of the prior art providing a new method to control aggregation of particles thereby forming a high quality uniform films of two-dimensional particles at a high efficiency.

SUMMARY OF THE INVENTION

The present invention intends to solve the above problems and provides a method for forming a two-dimensional particle in the form of a thin film comprising the steps of spreading a particle containing or particle forming liquid onto the surface of a high density liquid, reducing a thickness of said particle containing or particle forming liquid to form a two-dimensional assembly of particles on the surface of a liquid, contacting a solid substrate to the two-dimensional particle thin film aggregate formed, and transferring the two-dimensional particle thin film to the surface of a solid substrate by fixation of the thin film of particles to the surface of solid substrate.

DETAILED DESCRIPTION OF THE INVENTION

Figure 1A:
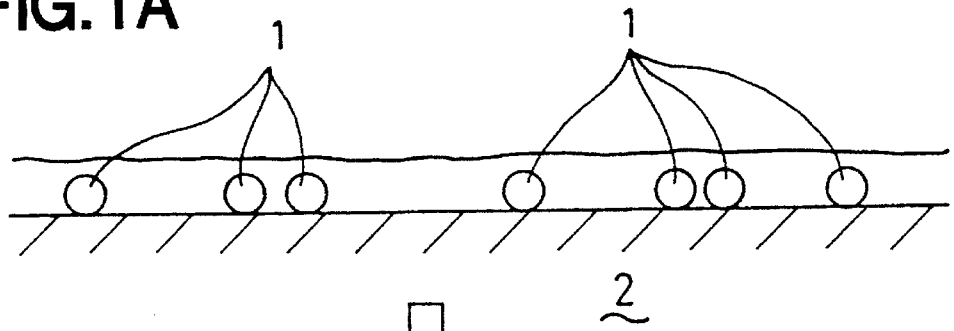
FIG. 1 shows a conceptual diagram illustrating the method of the present invention whereby a two-dimensional thin film of particles is formed.
Figure 1B:
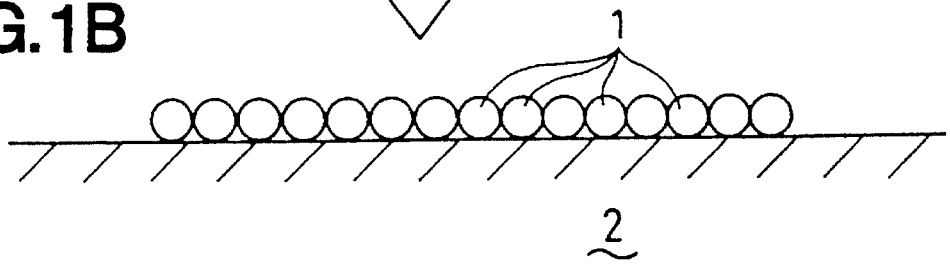
Figure 1C:
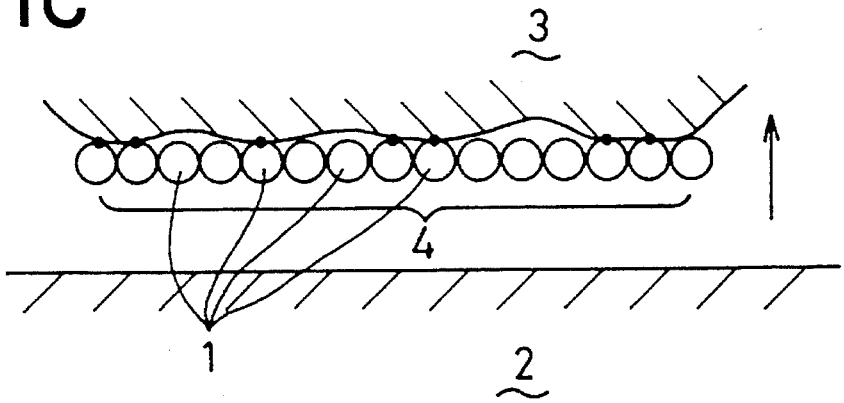

The present invention is conceptually illustrated by FIG. 1. The following steps, in accordance with FIG. 1, are indicated as the method of the present invention.

Liquid containing particles (1) or formed particles are spread on the surface of a high density liquid (2) serving as the primary substrate. The thickness of said liquid is reduced by evaporation, sucking up the liquid, etc. The two-dimensional aggregation of particles is formed by flow force, etc., generated from above said control. The high density liquid (2) is flatter and cleaner than conventional substrates that suffer from poor flatness and low level of cleanliness, and behaves like a solid substrate, resulting in substantial cohesion imparted to the particles (1) via uniform lateral liquid immersion force, laminar flow force, etc.

With the present invention further, it is possible to transfer particles (1) aggregated on the high density liquid (2) to the surface of a solid substrate (3) serving as the secondary substrate and fixing the two-dimensional crystal-like or crystalline fine particle thin film (4) thereupon. In this way, thin film fixation is possible.

The high density liquid (2) used in the present invention may be, for example, a high density liquid such as mercury, gallium or other metal liquid that will not cause penetration of the above-mentioned particles (1) and liquid. The solid substrate serving as the secondary substrate may be, for example, a carbon substrate, an LB film substrate, glass substrate, synthetic high molecular substrate, natural high molecular substrate, mica or other inorganic substrate. These solid substrates (2) are selected according to the affinity required for the transfer and fixation of particles (1).

In the present invention, further, particles (1) made of synthetic and natural resins, inorganic, metallic, and other substances are used. These particles (1) may be dispersed in water, organic solvent, etc., or the particles (1) may be formed by precipitation from a solution.

With the present invention, further, the thickness of the spread liquid film is controlled by, for example, evaporating the liquid containing particles (1) or by controlling the liquid pressure in order to aggregate the particles (1) two-dimensionally. In this case, cohesion is induced and becomes effective when the liquid thickness is reduced to or below the diameter of the particles (1), making it possible to control the aggregation speed, and form particles of a two-dimensional thin film in which the particle size of the aggregated substances has been controlled. When the particle diameter is nonuniform, the aggregation density of the larger particles is faster than that of the smaller particles. By using this phenomenon, it is possible, for example, to form particles of a large diameter at the center and particles of a small diameter around the center or around the particles of a large diameter.

The two-dimensional particles aggregation process for achieving powerful and fast aggregation of particles for forming a two-dimensional particle thin film is further described below. The particle aggregation process of the present invention comprised essentially two processes, a core formation and a crystal-like growth processes.

There are many factors in the core formation process. The lateral liquid immersion force is considered by the present inventor.

Figure 2:
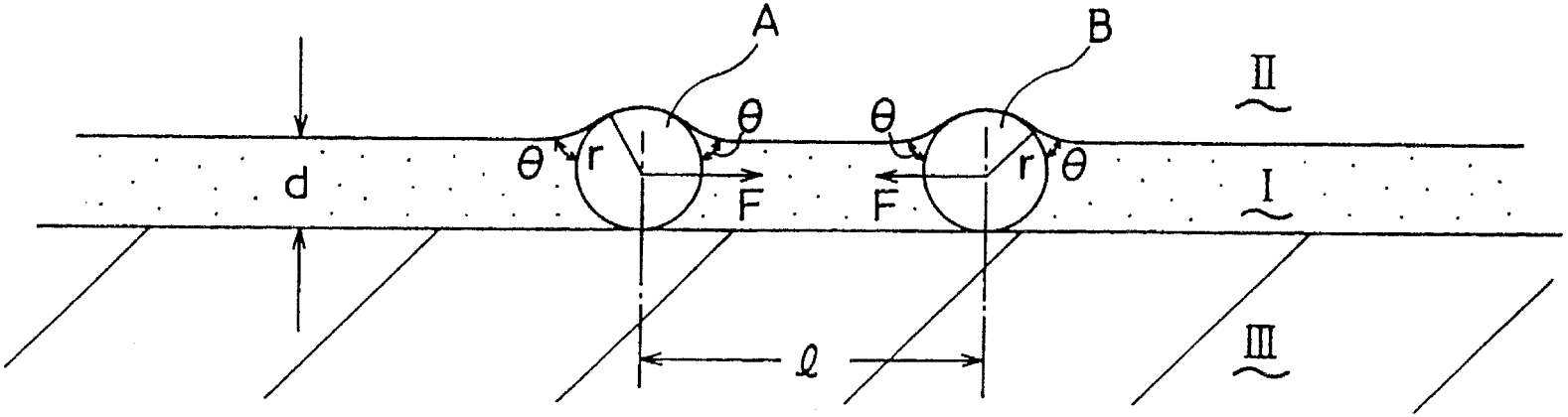
FIG. 2 shows a conceptual sectional diagram illustrating the mechanism of aggregation of the two-dimensional particles in the present invention.

The lateral liquid immersion force is described below. As exemplified in FIG. 2, particles A and B dispersed in liquid I are spread over substrate III having a flat surface and the thickness d of liquid I is reduced down to approximately the diameter of particles A and B, particularly to a dimension lower than the diameter of the particles, thus causing a large sucking force F to act on particles A and B to form core two dimensional aggregation of particles.

It is theoretically predictable that the lateral liquid immersion force acting as the sucking force F varies with contact angle between the particle and liquid I, the thickness d of liquid I at a point far enough from particles, the diameter 2r of particles A and B, the interfacial tension between liquid I and medium II (surface tension if the liquid I is air), and the differences in density between liquid I and medium II. The lateral liquid immersion force is effective over a long distance and is proportional to the inverse of the distance l between particles. The attraction is at work between particles which are significantly far apart because the lateral liquid immersion force is effective over such a long distance.

The more wettable particles are to a liquid dispersion medium, the greater the attraction, and the faster the two-dimensional aggregation for forming the crystal-like cores.

As described above, the core assembly of particles are formed at a certain point on a substrate having a flat surface mainly owing to the attraction between particles and lateral liquid immersion force.

Figure 3:
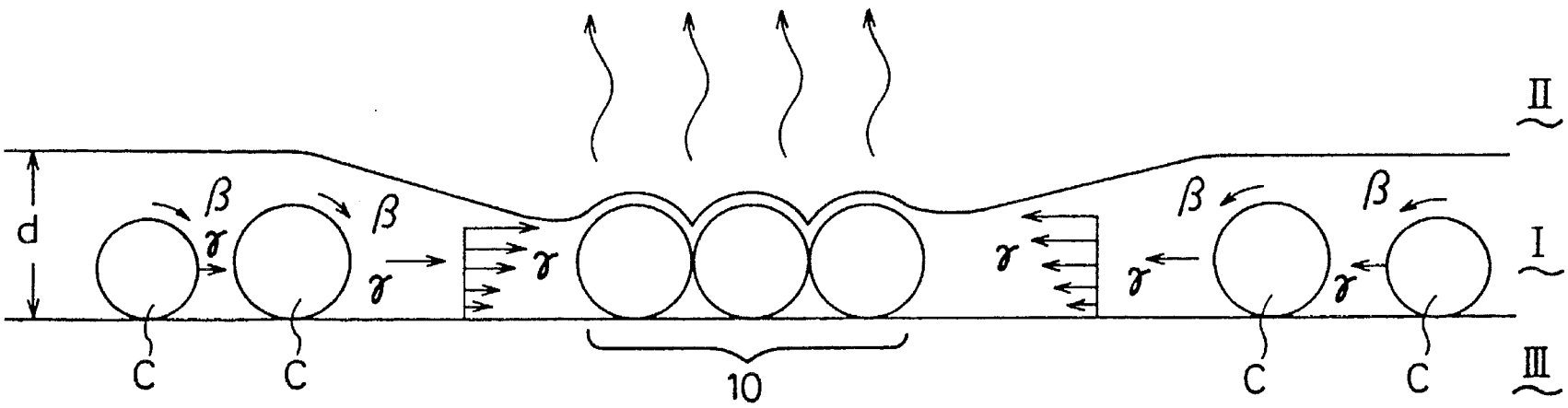
FIG. 3 shows a conceptual sectional diagram illustrating the mechanism of aggregating of two-dimensional particles in the present invention.

Aggregation of particles in the crystal-like growth process also depends on the laminar flow occurring in the particle liquid I as a result of evaporation, etc., as exemplified in FIG. 3. Needless to stay, the attraction between the particles and the lateral liquid immersion force are at work also in the crystal-like growth process.

That is, the evaporation increases near the core area 10, which was formed in the above core formation process, when liquid I is evaporated, and the liquid thickness is reduced to about the same size as the particles. The liquid around the core area 10 flows into the core in an attempt to keep the liquid thickness d uniform, thereby creating a laminar flow in the liquid. The speed distribution ($\alpha$) of the laminar flow force is the largest near the surface of the liquid owing to the friction with the substrate III, and decreases as the flow approaches the substrate. For this reason, a speed gradient is produced in the liquid and a rotating force ($\beta$) is induced in particles C. The particles are aggregated around core area as they are rolled on the substrate under rotating force ($\beta$) and parallel forwarding force ($\gamma$). The rotating force ($\beta$) and parallel forwarding force ($\gamma$) work as a force to separate the particles off the substrate III when the particles are adhered to substrate III, thereby promoting a smooth two-dimensional aggregation or formation of an excellent two-dimensional assembly. The laminar flow in liquid I, resulting from evaporation, has a limiting thickness, which is estimated at approximately 1 mm below the surface. Accordingly, the size of the particle should preferably be 1 mm or less in the present invention.

The two-dimensional particle thin film on the surface of a high density liquid is fixed to a surface of a solid substrate.

The fixation of the thin film to the surface of a solid substrate depends on physical, on physico-chemical absorption force or linkage force between the particles of thin film add the surface of the solid substrate. It is preferable for the fixation that a solid substrate be employed having a more larger surface active force, such as a carbon surface.

It is possible to produce uniform solid thin film by melting and sintering the two-dimensional particle thin film produced by the fixation process above-mentioned. When this thin film is applied in the field of optics, for example, it is possible to produce high precision optical reflection filters, photographing lens, copy lens, glare preventive film, various sol id film, etc.

Further, the thin film formed by the present invention can be fixed as individual patterns, or converted into film structure of excellent functionality by chemically modifying the film or processing, and by modifying or otherwise treating the film by light, such as laser. It is also possible to make multi layered film from single layer films. One can also to apply the method to the production of new functional materials to be used in various industrial fields such as electronics, bio-materials, ceramics, and metals.

Regarding the substrate, it is preferable to form two-dimensional particles thin film by use of mercury or gallium liquid as a high density liquid and to use a carbon solid substrate or film thereof, OB film, glass plate substrate, synthetic high molecular substrate, natural high molecular substrate, or an inorganic substrate as a solid substrate.

The liquid above mentioned is preferably selected from the group of water, alcohols, eathers, esters, hydrocorbon, other organic medium and mixtures thereof. There is no limitation regarding the kinds of particles and the size thereof.

Various kinds of organic particles may be used. Inorganic particles or metal particles may be also used.

High molecular polymer materials, such as polystyrene, polyvinylchloride, polyesters, polydienes, styrene-butadiene copolymers, and acrylic acid ester-maleic acid ester copolymers are used as the particles.

Inorganic materials, such as $TiO_2$, $ZrO_2$, $Al_2O_3$, TiN, $Si_3N_4$, SiC, $BaTiO_3$, and metals, such as Ti, Ni, Al, Zr, Cu, Ti-Ni alloys, Ni-Cr alloys, Cr-Mo alloys, Au, Ag, Pd, and Pt are used for the substance of the particles.

The particle may have a size from nanometer order to millimeter order. Nanometer size particles are preferably used.

The present invention will be described in more detail by referring to the working examples below.

EXAMPLE 1

A two-dimensional thin film of particles was produced using the above method of the present invention.

Mercury was used as the high density liquid serving as the primary flat substrate. A 20 nm thick carbon thin film on the glass plate was used as the solid substrate serving as the secondary substrate for fixing the thin film of particles.

A small quantify of ferritin particles of approximately 12 nm particle size dispersed in water was developed over a clean surface of mercury.

The water was then evaporated in order to reduce the thickness of a liquid. Formation of a core crystal-like aggregation occurred when the liquid thickness was 0.09 m. Immediately after the formation of the core area of particles, certain particles started to aggregate quickly and formed a most densely packed two-dimensional single particle layer.

Figure 4:
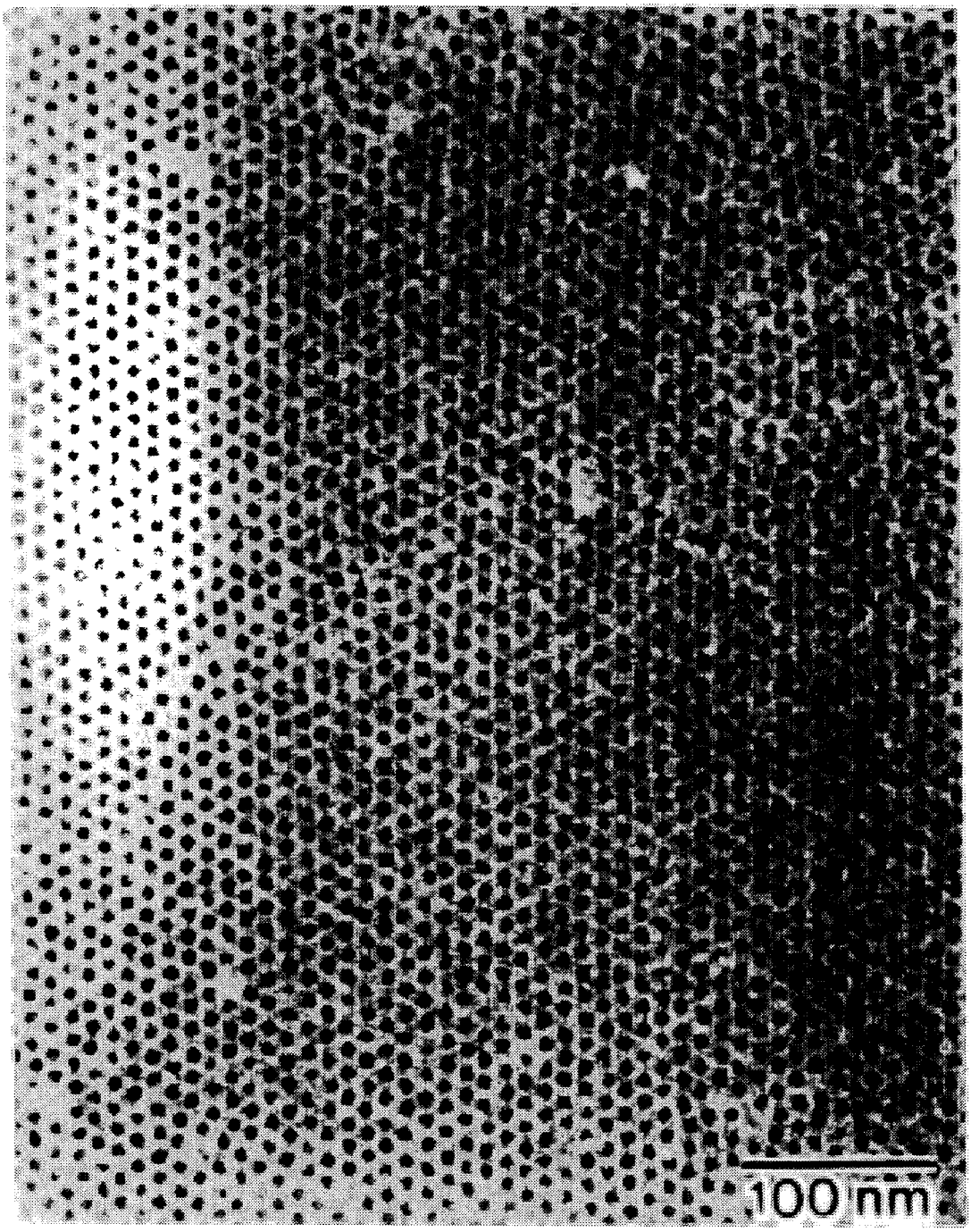
FIG. 4 shows an electron micrograph showing the result of the working example of the present invention.

A 20 nm thick carbon thin film serving as the secondary solid substrate was then brought into direct contact with the above two-dimensional particle layer for transfer and fixation. The particle layer is fixed on the surface of the solid by physical absorption or adhesion. FIG. 4 is an electron micrograph of the two-dimensional ferritin crystal-like particle thin film thus transferred.

In this way, thin film of the most densely packed two-dimensional aggregation assembly of nanometer-sized particles was formed on a solid substrate.

EXAMPLE 2

In like manner as example 1, a small quantity of a mixture of polystyrene particles of approximately 55 nm and 144 nm particle sizes dispersed in water was spread over a clean surface of mercury. Two-dimensional crystal thin film was formed from these particles.

The water was then evaporated in order to reduce the thickness of liquid. Formation of core crystal-like assembly occurred when the liquid thickness was 1.20 m. Immediately after the formation of the core assembly, polystyrene particles started to aggregate quickly and formed the most densely packed two-dimensional single particle layer.

Figure 5:
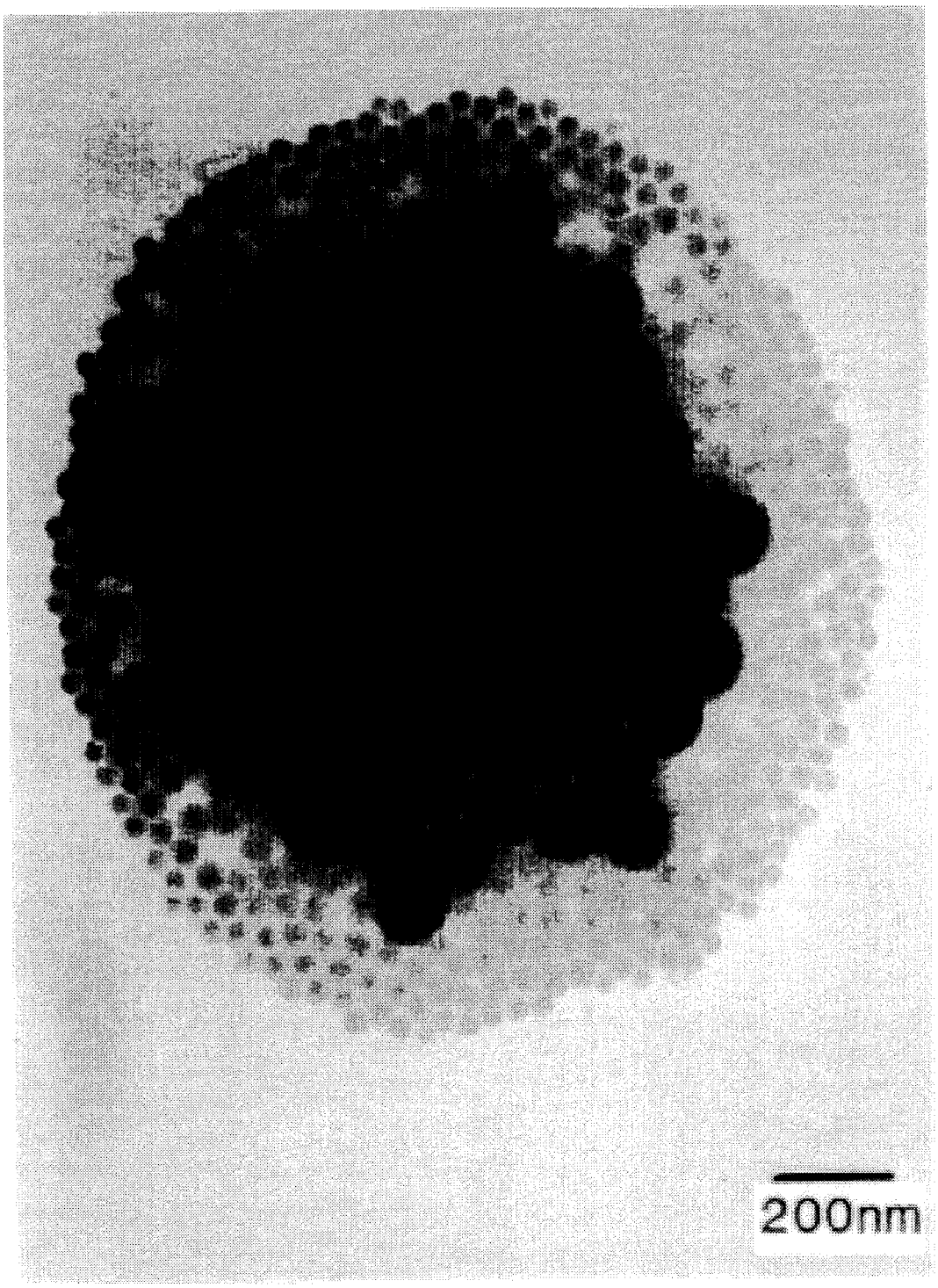
FIG. 5 illustrates an electron micrograph showing the results of another working example of the present invention.

FIG. 5 is an electron micrograph of the two-dimensional crystal-like particle thin film consisting of polystyrene particles thus transferred and fixed on a carbon thin film substrate. FIG. 5 clearly shows that polystyrene particles of 144 nm particle size have flocculated at the center and polystyrene particles of 55 nm particle size at the periphery.

EXAMPLE 3

Polystyrene particles of 55 nm particle size only were used in working example 2 to transfer and to fix a two-dimensional particles thin film on a carbon thin film substrate.

Figure 6:
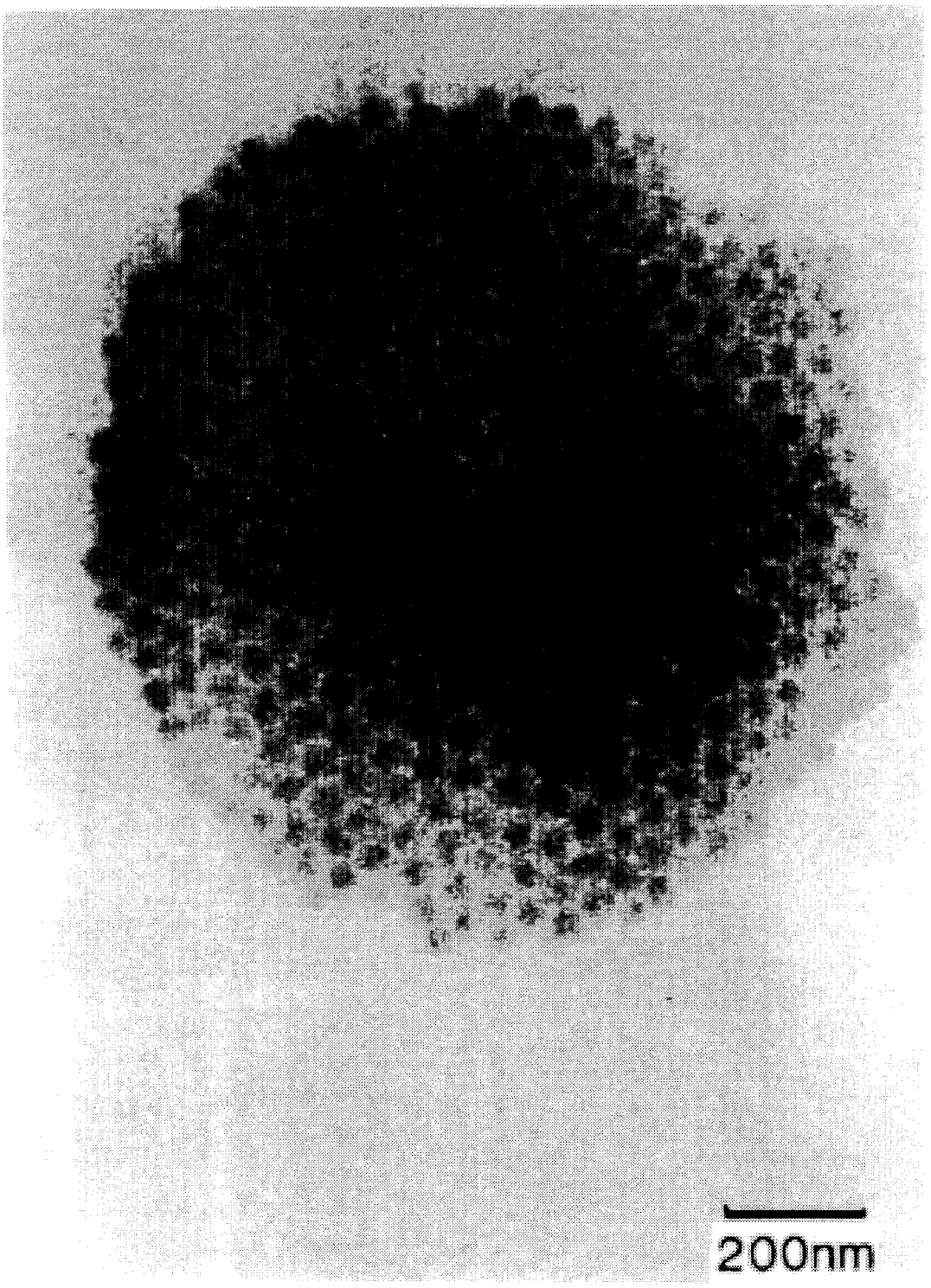
FIG. 6 illustrates an electron micrograph showing the results of still another working example of the present invention.

FIG. 6 is the relevant electron micrograph.

As described in detail above, it is possible with the method by using a high density liquid as primary substrate to realize a perfectly fiat surface and a clean surface free from dust, oxide film, etc.

Thus, it is possible with the present invention by using the high density liquid and the solid secondary substrate for transfer of particle thin film to fix or immobilize the thin film.

Further again, it is possible with the present invention by using the lateral liquid immersion force and laminar flow force to realize a high level two-dimensional particle aggregation assembly as a fine controlled state.

For these reasons, it is possible to form high quality two-dimensional particle thin film quickly by using the method disclosed in the present invention.

I claim:

1. A method for forming a film of a two-dimensional array of particles by applying a liquid dispersive medium, containing particles having a diameter of 1 mm or less dispersed therein, onto a surface of a liquid having a density higher than that of the liquid dispersive medium containing particles, reducing the thickness of said liquid dispersive medium containing particles to a thickness of approximately the diameters of the particles and below to form a film of a two-dimensional array of particles on the surface of the higher density liquid by the combined action of a lateral immersion force among the particles in the liquid dispersive medium and a laminar flow of the liquid dispersive medium, contacting said film of a two-dimensional array of particles with a surface of a solid substrate to transfer the particles from the surface of the higher density liquid onto the surface of said solid substrate and affixing the particles to the surface of said substrate.

2. A method according to claim 1 wherein said higher density liquid is a liquid metal.

3. A method according to claim 2 wherein said liquid metal is selected from the group consisting of mercury and gallium.

4. A method according to claim 1 wherein said higher density liquid is selected from the group consisting of mercury and gallium and wherein said solid substrate is selected form the group consisting of a carbon substrate, a glass substrate, and an inorganic substrate.

5. A method according to claim 4 wherein said particles are selected from the group consisting of polystyrene, polyvinylchloride, polyesters, polydienes, styrene-butadiene copolymers, acrylic acid ester-maleic acid ester copolymers, $TiO_2$, $ZrO_2$, $Al_2O_3$, TiN, $Si_3N_4$, SiC, $BaTiO_3$, Ti, Ni, Al, Zr, Cu, Ti-Ni alloys, Ni-Cr alloys, Cr-Mo alloys, Au, Ag, Pd and Pt and wherein the liquid dispersive medium is selected from the group consisting of water, hydrocarbon liquids, alcohols, ethers, and esters.

6. A method according to claim 1 wherein said particles are selected from the group consisting of polystyrene, polyvinylchloride, polyesters, polydienes, styrene-butadiene copolymers, acrylic acid ester-maleic acid ester copolymers, $TiO_2$, $ZrO_2$, $Al_2O_3$, TiN, $Si_3N_4$, SiC, $BaTiO_3$, Ti, Ni, Al, Zr, Cu, Ti-Ni alloys, Ni-Cr alloys, Cr-Mo alloys, Au, Ag, Pd and Pt and wherein the liquid dispersive medium is selected from the group consisting of water, hydrocarbon liquids, alcohols, ethers, and esters.

7. A method according to claim 1 wherein the thickness of the liquid medium is reduced by evaporation or sucking the liquid medium from the surface of the high density liquid.

8. A method according to claim 1, wherein the particles are affixed to the surface of the solid substrate by physical absorption or adhesion.

9. A method according to claim 1, wherein the film of the two-dimensional array of particles is transferred from the higher density liquid to the solid substrate by positioning the solid substrate directly atop the two-dimensional array of particles and contacting the solid substrate with the particles on the higher density liquid to transfer it onto the solid substrate.

* * * * *